United States Patent [19]

Lochner et al.

[11] 3,948,686

[45] Apr. 6, 1976

[54] ZINC DUST PRIMER SYSTEMS FOR METAL SHEETS DEFORMABLE BY NONCUTTING PROCESSES

[75] Inventors: Karl-Heinz Lochner, Bonn; Johann Lenzen, Dusseldorf, both of Germany

[73] Assignee: Bonaval-Werke GmbH, Bonn, Germany

[22] Filed: Oct. 23, 1974

[21] Appl. No.: 517,355

[30] Foreign Application Priority Data

Oct. 26, 1973 Germany ..... 2353701

[52] U.S. Cl. ..... 148/6.15 R; 148/6.15 Z; 148/6.2; 148/31.5; 427/306; 72/47

[51] Int. Cl.[2]... C23F 7/08; C23F 7/26; C23C 17/00

[58] Field of Search ..... 117/71 M, 31; 72/47; 148/6.2, 31.5, 6.16, 6.15 R, 6.15 Z; 427/406

[56] References Cited

UNITED STATES PATENTS

| | | | |
|---|---|---|---|
| 2,436,420 | 2/1948 | Clayton | 117/71 M |
| 2,703,768 | 3/1955 | Hall | 148/6.15 R |
| 2,798,509 | 7/1951 | Bergquist | 117/71 M X |
| 3,687,738 | 8/1972 | Malkin | 148/6.2 |

*Primary Examiner*—Ralph S. Kendall

*Attorney, Agent, or Firm*—Luther A. R. Hall

[57] ABSTRACT

The invention relates to a zinc dust primer system which renders possible a mass production working of metal sheets by noncutting processes. The said primer system consists of a lower or bottom layer containing the actual zinc dust primer, and a covering layer containing a substance promoting sliding and a binder. A suitable substance promoting sliding is, in particular, graphite. The system of the invention is especially applicable in the automobile, shipbuilding and packing industries and in the construction of steel furniture. It is of special interest in the case of the coil-coating process.

12 Claims, No Drawings

ZINC DUST PRIMER SYSTEMS FOR METAL SHEETS DEFORMABLE BY NONCUTTING PROCESSES

Corrosion-preventing coatings for metals, which are based on paints containing zinc dust, are known. The protective action in the case of this system is due, as is known, to the more negative potential of the zinc with respect to the metal to be protected. Furthermore, there are also known corrosion-preventing coatings which contain, as the essential constituent, hexavalent chromium, optionally in addition to zinc and other metals.

To be mentioned in this connection as prior art are DT-OS 1,669,110, DT-OS 1,771,451, DT-AS 1,919,389 and DT-OS 1,925,029.

These known coatings protecting against corrosion have hitherto been used in engineering only where it is required to protect fairly small metal shapes or metal components which are not subjected to any further deformation after application to them of the coating containing zinc. Metal sheets that are shaped by noncutting processes after application of the coatings are, however, not effectively protected by such primer systems. The reason for the failure of the said coatings to provide protection is that the coating containing zinc and optionally further metals flakes off and is destroyed in the deformation process. At the same time there occurs as a further disadvantage a decontamination of the tools (for example, of the press tools) in consequence of the deposition of the coating material displaced as a result of abrasion, so that a mass-production shaping of sheets in large numbers is for this reason impossible.

The fact has to be stressed that actually there exists a great need for a process for the shaping of metal sheets by noncutting means, in which process the protection against corrosion remains fully intact, particularly with regard to the motor vehicle industry.

The aim of the invention is to provide a zinc dust primer system which renders possible a mass-production shaping of metal sheets by noncutting processes, whereby a mechanical damaging of the zinc dust primer, e.g., due to flaking, and a contamination of the tools by the flaked-off material are eliminated.

The subject of the invention is therefore a zinc dust primer system for metals which is deformable without suffering damage, and which is characterised in that on top of a lower layer (a) consisting of a zinc dust primer having a zinc content of 80 to 95 per cent by weight there is firmly adhering a covering film (b), which consists essentially of a mixture of 50 to 70 per cent by weight of a substance promoting sliding, and 50 to 30 per cent by weight of an organic binder based on high polymers or on substances forming high polymers.

The weight-% figures in the case of layer (a) relate to the total dry weight of the zinc dust primer of which this base layer consists; the weight-% figures for the covering film (b), however, relate to the total dry weight of this covering film.

The fact that it has been possible to fulfil the aim of the present invention so elegantly by virtue of the primer system according to the invention was surprising. Attempts have been made, namely, from an early date to reduce the susceptibility of known zinc dust primer systems to mechanical damage and destruction by increasing the proportion of binder in these primers.

An increase of resistance to abrasion was indeed effected by this measure, but the creation of a cathodic protection of the metal — the real aim of this measure — was, however, very disadvantageously influenced. Furthermore, it was not possible with an increase in the proportion of binder to fully retain the spot-welding property of the coated metal. With application of the zinc dust primer system according to the invention, however, a shaping of the coated metal sheets by noncutting processes is surprisingly possible without mechanical damage to the primer and with complete retention both of the cathodic protection and of the spot-welding property.

A further surprising fact was that in the case of the sheets provided with the primer according to the invention the usual surface-treatment processes, such as phosphating and electrophoretic coatings, can be carried out also again at a subsequent stage without damage to the zinc dust primers occurring. This repeated treatment could be performed, for example, in the automobile industry in routine production, or become necessary for the priming of the underside of the sheet provided only on the top side with zinc dust primer.

In the case of the layer (a) according to the invention, this is a normal known zinc dust primer system having a zinc content of 80 to 95 per cent by weight, relative to the weight of this known zinc dust primer.

Such primers contain as binders generally epoxide resins in admixture with urea resins or melamine/formaldehyde resins or with other amine resins, preferably epoxide fatty acid esters (such as epoxidised ricinine fatty acid ester). Basically, however, also other duroplasts are usable as binders.

The covering film (b) of the zinc dust primer according to the invention can contain, as a substance promoting sliding, an oil (also silicon oil), wax, fat, graphite, molybdenum sulphide or some other heavy metal sulphide, such as lead sulphide. Preferred substances promoting sliding are graphite and molybdenum sulphide.

The binder of the covering film (b) can contain, as high polymer or as substances forming high polymers, a polyester, an epoxide resin, a polyvinyl compound, a polyacrylic or polymethacrylic compound or corresponding initial products which can be polycondensed or polymerised to form high polymers. Polyvinylacetals, particularly polyvinylbutyral, are very suitable.

An especially preferred form of the invention is a zinc dust primary system which contains in the covering film (b) graphite as the substance promoting sliding, and polyvinylbutyral as the high polymer. The covering film (b) contains in most cases only the high polymer, or the substances forming high polymers, in addition to the substance promoting sliding. It can however also contain other substances (the usual additives for films and so forth), which to one skilled in the art are known to an extensive degree from publications and from relevant patent specifications. Mention may be made, for example, of diluents and toughening agents, plasticisers, levelling agents, dyestuffs and pigments and metal powders.

The zinc dust primer system of the invention is used preferably on iron and steel sheets. In principle, however, also other metals which are nobler than zinc, such as copper, nickel or brass, can be effectively protected by the zinc dust primer. Moreover, the invention is not limited to sheets, but is applicable also to compact metal shapes, such as to those made from cast iron.

With the application of the invention, the initial materials to be treated are preferably steel sheets which, after the usual degreasing in alkaline baths or by organic solvents, have been primed by a phosphating or chromating treatment. The sheets preliminarily treated in this manner are then provided, in the known manner, with the base layer (a) by application of a solution or dispersion of a conventional zinc dust primer system, using the spraying, dipping, brushing, flooding or coil-coating process, and by subsequent stoving. As is known, the solutions or dispersions suitable for this purpose generally have a solid content of 75 to 85 per cent by weight. Both aqueous systems and systems based on organic solvents are applicable.

Generally, a solution or dispersion of the mixtures of constituents (solid content 25 to 35 per cent by weight) is used initially also in the case of applying the coating of firmly adhering covering film (b). For this purpose too, both aqueous systems and systems based on organic solvents are suitable, and again application of the film is effected preferably by the spraying, dipping, brushing, flooding or coil-coating process. However, also quite applicable is a powder-coating process, which may be judged as being favourable from an ecological point of view, and this process can moreover be used for the application of the base layer (a). The application of film (b) is optionally followed by a drying and stoving process.

The zinc dust primer system of the invention should be present on the surface of the metal as a dry film having a total thickness of 12 to 25 microns: the thickness of layer (a) should be 10 to 20 microns and that of layer (b) 2 to 5 microns.

By virtue of the zinc dust primer system according to the invention, there is rendered possible an uninterrupted working of the appropriately coated sheets by noncutting processes of deformation. Without mechanical damage to the primer, the sheets can be, for example, pressed, deep drawn and flanged. In the case also of stamping, damage, which occurs on conventionally pretreated sheets, especially in the vicinity of the cutting zone, is to a great extent eliminated. Since in consequence of the invention there is made possible not only the working of very large sheets but also, for the first time, mass-production operations in connection therewith, the present invention constitutes a genuine contribution to the art, particularly with regard to the automobile industry. Further areas in which the invention will be applicable are in shipbuilding, in steel-furniture construction and in the packing industry.

EXAMPLE 1

The steel sheet used has a thickness of 1 mm and a width of 1.85 m, and has been degreased in an alkaline bath in the conventional manner, and the surface of the sheet has been preliminarily treated by the known iron-phosphating process.

The solutions A and B described below are used for the further treatment of the surface. In these recipes, 'parts' are expressed in each case as parts by weight.

| | |
|---|---|
| Solution A (zinc dust primer solution) | |
| thermosetting, plasticised epoxide resin | 5.2 parts |
| cycloaliphatic epoxide (epoxide equivalent 210–215) | 1.5 parts |
| zinc dust (99.9% Zn) | 73.0 parts |
| hydrogenated castor oil (specif. weight 1.021) | 1.0 part |
| pure resin/formaldehyde condensate | 1.1 parts |

-continued

| | |
|---|---|
| (tinting No. 0-2, acid No. max. 3) | |
| xylene | 2.2 parts |
| ethyl glycol acetate | 13.0 parts |
| isophorone | 3.0 parts |
| total | 100.0 parts |
| Solution B (solution for the covering film (b)) | |
| polyvinylbutyral (81–84% acetal, 1% acetate, 15% alcohol) | 10 parts |
| pulverulent graphite | 20 parts |
| xylene | 25 parts |
| glycol ether acetate | 20 parts |
| glycol ether (ethyl glycol) | 5 parts |
| hydrocarbon (arom. boiling limits 162–180°C. specif. weight 0.877, $N_D^{20}$: 1.4985) | 20 parts |
| total | 100 parts |

The steel sheet wound from the coil is coated on a roll coater with solution A, and subsequently stoved in a pusher-type furnace at a temperature of between 240° and 260°C. The duration of treatment is 1 minute. The dry-film thickness of the applied zinc dust primer is about 15 microns.

After cooling of the sheet to 20° to 25°C, it is passed through a second roll coater and coated with the solution B. This operation is followed by drying of the film in a pusher-type furnace at 240°C (duration 1 minute). The layer thickness of the dry film applied in this manner onto the zinc primer is 3 microns. After cooling, the thus coated steel strip is wound again into a coil by means of a coiling machine.

A square piece (200 × 200 × 1 mm) of the sheet modified in the described manner is deep drawn on a circular area (diam. 50 mm) to a depth of 10 mm.

The primer is not in any way damaged. The zinc dust primer layer (resulting from coating with solution A) is still firmly adhering to the pretreated steel base. There is a complete absence of crumbling of the zinc dust layer. The homogeneous distribution has been maintained fully intact.

Furthermore, no separation whatsoever of the covering film (resulting from coating with solution B) from the base layer (a) containing the zinc dust can be detected. Both films remain firmly adhering together.

The deep-drawing tool carries, even after the abovedescribed deep-drawing operation has been performed 100 times (using a fresh sample of sheet in each case), no deposit of zinc dust or of binder.

EXAMPLE 2

A steel sheet is used which has the same dimensions as that employed in Example 1, which however has been preliminarily treated using the zinc phosphating method.

The solutions C and D described below are used in the present case for the further treatment of the surface.

| | |
|---|---|
| Solution C (zinc dust primer solution) | |
| epoxide fatty acid ester (40% ricinine fatty acid) | 5.2 parts |
| epoxide resin (bisphenol-A-type) | 1.5 parts |
| zinc dust (99.9% Zn) | 73.0 parts |
| hydrogenated castor oil | 1.0 part |
| specif. weight 1.021) | |
| pure urea/formaldehyde condensate | 1.1 parts |
| (tinting No. 0-2; acid No. max. 3) | |
| xylene | 2.2 parts |
| ethyl glycol acetate | 13.0 parts |
| isophorone | 3.0 parts |

-continued

| | |
|---|---|
| total | 100.0 parts |
| Solution D (solution for the covering film (b)) | |

The solution corresponds to solution B. Instead of graphite, however, it contains the same amount of molybdenum sulphide.

The further modification of the surface of the steel sheet is performed in the same manner as in Example 1, the only exception being that solutions C and D are used.

The same deep-drawing test is carried out as in Example 1. The result regarding the complete absence of damage to the zinc dust film, the adhesion of the base layer and covering film and the retained clean condition of the tools, even after 100 performances of the deep-drawing operation, is just as favourable as in Example 1.

EXAMPLE 3 (comparative example)

An iron sheet (1 mm thick, 1.85 m wide), pretreated by iron phosphating according to Example 1, is modified only by application of solution A using the procedure described in Example 1. After stoving of the film (dry-film thickness 15 microns) and cooling, the same deep-drawing test as in Example 1 is carried out. After deep drawing, the zinc dust primer layer is damaged and has flaked off. After 100 performances of the deep-drawing operation, the deep-drawing tool (the deep-drawing ram) is contaminated and encrusted with material resulting from abrasion, to the extent that no further accurate shaping is possible.

What we claim is:

1. An improved zinc dust primer system for metal which primer system can be deformed without suffering damage and which comprises a lower layer (a), applied to a metal layer or base which has been preliminarily treated by phosphating or chromating, consisting of a zinc dust primer having a zinc content of 80 to 95 percent by weight, wherein the improvement comprises a firmly adhering covering film (b) which consists essentially of a mixture of 50 to 70 percent by weight of a substance promoting sliding selected from the group consisting of oil, silicone oil, wax, fat, graphite, molybdenum sulphide and other heavy metal sulphides, and 50 to 30 percent by weight of an organic binder based on high polymers or on substances forming high polymers.

2. An improved zinc dust primer system according to claim 1, wherein the covering film (b) contains, as the substance promoting sliding, graphite or molybdenum sulphide.

3. An improved zinc primer system according to claim 1, wherein the high polymer contained in the covering film (b) is a polyester resin, an epoxide resin, a polyvinyl compound, a polyacrylic or polymethacrylic compound or corresponding initial products that can be polycondensed or polymerised to form high polymers.

4. An improved zinc dust primer system according to claim 3, wherein the high polymer contained in the covering film (b) is polyvinylbutyral.

5. An improved zinc dust primer system according to claim 1, wherein the covering film (b) contains graphite as the substance promoting sliding, and polyvinylbutyral as the high polymer.

6. A process for modification of metal surfaces with an improved zinc dust primer system for metal which primer system can be deformed without suffering damage and which comprises a lower layer (a), applied to a metal layer or base which has been preliminarily treated by phosphating or chromating, consisting of a zinc dust primer having a zinc content of 80 to 95 percent by weight, wherein the improvement comprises applying a firmly adhering covering film (b) which consists essentially of a mixture of 50 to 70 percent by weight of a substance promoting sliding selected from the group consisting of oil, silicone oil, wax, fat, graphite, molybdenum sulphide and other heavy metal sulphides, and 50 to 30 percent by weight of an organic binder based on high polymers or on substances forming high polymers.

7. A process according to claim 6, wherein there is applied a covering film (b) containing graphite or molybdenum sulphide as the substance promoting sliding.

8. A process according to claim 6, wherein there is applied a covering film (b) containing, as the high polymer, a polyester resin, an epoxide resin, a polyvinyl compound, a polyacrylic or polymethacrylic compound or corresponding initial products that can be polycondensed or polymerised to form high polymers.

9. A process according to claim 8, wherein there is applied a covering film (b) containing polyvinylbutyral as the high polymer.

10. A process according to claim 6, wherein there is applied a covering film (b) containing graphite as the substance promoting sliding, and polyvinylbutyral as the high polymer.

11. A process according to claim 6, wherein the covering film (b) is applied by application of a solution or dispersion of the constituents for the covering film (b) using the spraying, brushing, dipping, flooding or coil-coating process, and subsequent removal of the solvent or dispersing agent by evaporation.

12. A process according to claim 6, wherein the covering film (b) is applied by a powder-coating process.

* * * * *